US005536202A

United States Patent [19]

Appel et al.

[11] Patent Number: 5,536,202

[45] Date of Patent: Jul. 16, 1996

[54] SEMICONDUCTOR SUBSTRATE CONDITIONING HEAD HAVING A PLURALITY OF GEOMETRIES FORMED IN A SURFACE THEREOF FOR PAD CONDITIONING DURING CHEMICAL-MECHANICAL POLISH

[75] Inventors: Andrew T. Appel, Dallas; Michael F. Chisholm, Plano, both of Tex.

[73] Assignee: Texas Instruments Incorporated, Dallas, Tex.

[21] Appl. No.: 281,391

[22] Filed: Jul. 27, 1994

[51] Int. Cl.[6] ..... B24B 5/00; B24B 29/00

[52] U.S. Cl. ..... 451/285; 451/526; 451/287; 451/36

[58] Field of Search ..... 451/285, 287, 451/398, 36, 56, 446, 550

[56] References Cited

U.S. PATENT DOCUMENTS

| | | | |
|---|---|---|---|
| 4,057,939 | 11/1977 | Basl | 451/36 |
| 5,045,870 | 9/1991 | Lamey et al. | 346/140 R |
| 5,063,655 | 11/1991 | Lamey et al. | 29/611 |
| 5,216,843 | 6/1993 | Brievogel et al. | 51/237 |
| 5,222,329 | 6/1993 | Yu | 451/11 |
| 5,294,814 | 3/1994 | Das | 457/77 |
| 5,329,734 | 7/1994 | Yu | 451/526 |
| 5,332,467 | 7/1994 | Sune et al. | 156/636 |

FOREIGN PATENT DOCUMENTS

| | | | |
|---|---|---|---|
| 362259769 | 11/1987 | Japan | 451/287 |

*Primary Examiner*—Bruce M. Kisliuk
*Assistant Examiner*—Derris H. Banks
*Attorney, Agent, or Firm*—Jacqueline J. Garner; William E. Hiller; Richard L. Donaldson

[57] ABSTRACT

A pad conditioning method and apparatus for chemical-mechanical polishing. A polishing pad (114) is attached to a platen (112) and used to polish a wafer (116). Rotating arm (118) positions the wafer (116) over the pad (114) and applies pressure. During wafer polishing particles build up on the polishing pad (114) reducing its effectiveness. Either during or in between wafer polishing (or both), conditioning head (122) is applied to pad (114) to remove the particles from pad (114) into the slurry (120). Conditioning head (122) comprises a semiconductor substrate (126) that is patterned and etched to form a plurality of geometries (128) having a feature size on the order of polishing pad (114) cell size.

20 Claims, 2 Drawing Sheets

SEMICONDUCTOR SUBSTRATE CONDITIONING HEAD HAVING A PLURALITY OF GEOMETRIES FORMED IN A SURFACE THEREOF FOR PAD CONDITIONING DURING CHEMICAL-MECHANICAL POLISH

FIELD OF THE INVENTION

This invention generally relates to semiconductor processing and more specifically to pad conditioning in chemical-mechanical polishing.

BACKGROUND OF THE INVENTION

As circuit dimensions shrink the need for fine-line lithography becomes more critical and the requirements for planarizing topography becomes very severe. Major semiconductor companies are actively pursuing Chemical-Mechanical Polishing (CMP) as the planarization technique used in the sub-half micron generation of chips. CMP is used for planarizing bare silicon wafers, interlevel dielectrics, and other materials. CMP machines, such as the one shown in FIG. 1, use orbital, circular, lapping motions. The wafer 16 is held on a rotating carrier 18 while the face of the wafer 16 being polished is pressed against a resilient polishing pad 14 attached to a rotating platen disk 12. A slurry 20 is used to chemically attack the wafer surface to make the surface more easily removed by mechanical abrasion.

As CMP stands today it is a very costly process to implement. One of the major costs of running CMP are the 'consumables'. These include polishing pads, polishing slurry, wafer backing pads and various machine parts which are worn out during polishing. The polishing pads represent a major cost, as much as five dollars per product wafer run. In highly integrated devices utilizing multilevel interconnect systems each wafer can use five or six CMP steps. This makes the cost for polishing pads alone $25 to $30 per wafer.

These polish pads are worn out from both the polishing process and the pad conditioning which is necessary to make the pad ready for wafer polishing. The pad conditioning is currently done by mechanical abrasion of the pads in order to 'renew' the surface. During the polishing process, particles removed from the surface of the wafer and from the spent slurry become embedded in the pores of the polishing pad. This reduces the effectiveness of the polishing pad. Conditioning removes depleted slurry from surface and opens pores in the pad which were blocked by particles. The open pores provide more surface area for polishing with new slurry. Current techniques, such as the one shown in FIG. 1 use conditioning heads 24 with abrasive diamond studs 26 which are macroscopic in relation to the cells in the polishing pad. Thus, the mechanical abrasion of the polishing pads wears the pad, reducing its lifetime. In addition, the diamond studs 26 are not evenly distributed over the surface of the conditioning head. This causes uneven conditioning.

SUMMARY OF THE INVENTION

A method and apparatus for conditioning a polishing pad is disclosed. A conditioning head is provided which comprises a semiconductor substrate having a non-planar surface. In one embodiment, the non-planar surface comprises a plurality of geometries having a feature size on the order of the cell size of the polishing pad. The non-planar surface of the conditioning head is used to mechanically abrade the surface of the polishing pad to remove unwanted particles from the polishing pad.

An advantage of the invention is providing a method and apparatus for conditioning a polishing pad that has feature sizes on the order of the polishing pad cell size to reduce the physical wear on the polishing pad.

A further advantage of the invention is providing a method and apparatus for conditioning a polishing pad that increases the life of the pad and reduces the overall cost of chemical-mechanical polishing.

A further advantage of the invention is providing a method and apparatus for conditioning a polishing pad that has an even distribution of geometries for uniform pad conditioning.

These and other advantages will be apparent to those of ordinary skill in the art having reference to this specification in conjunction with the drawings.

BRIEF DESCRIPTION OF THE DRAWINGS

In the drawings.

Corresponding numerals and symbols in the different figures refer to corresponding parts unless otherwise indicated.

DETAILED DESCRIPTION

The invention will be described in conjunction with pad conditioning for chemical-mechanical polishing (CMP). The major emphasis of CMP today is for planarizing interlevel dielectrics on a semiconductor wafer. However, other uses are also possible such as, selectively removing metals and planarizing bare silicon wafers. The invention is equally applicable to these uses.

CMP involves both chemical and mechanical abrasion. Chemical abrasion is accomplished using a slurry to chemically weaken the surface of a wafer. Mechanical abrasion is accomplished using a polishing pad against which a wafer surface is pressed. Both the polishing pad and the wafer are rotated to cause the removal of surface material. The removed material is then washed over the edges of the polishing pads and into a drain by adding additional slurry. CMP planarization produces a smooth, damage-free surface for subsequent device processing. It requires fewer steps than a deposition/etchback planarization and has good removal selectivity and rate control. For silicon dioxide, removal rates on the order of 60–80 nm/min for a thermal oxide and 100–150 nm/min for an LPCVD (low pressure chemical-vapor deposition) oxide can be achieved.

Figure 1:
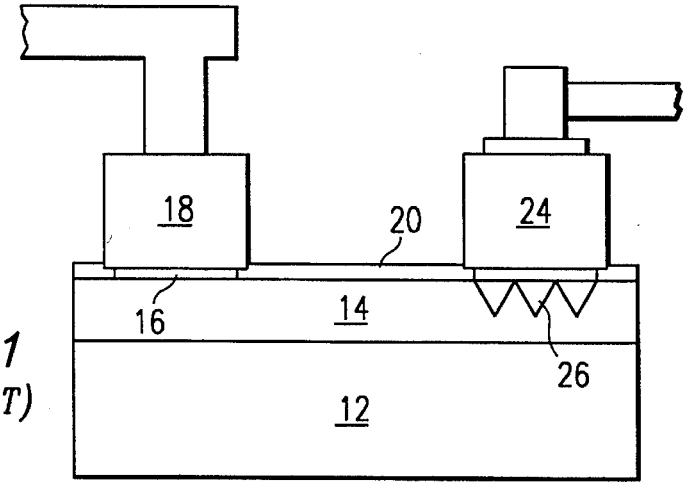
FIG. 1 (PRIOR ART)
FIG. 1 is a cross-sectional view of a prior art CMP machine.
Figure 2:
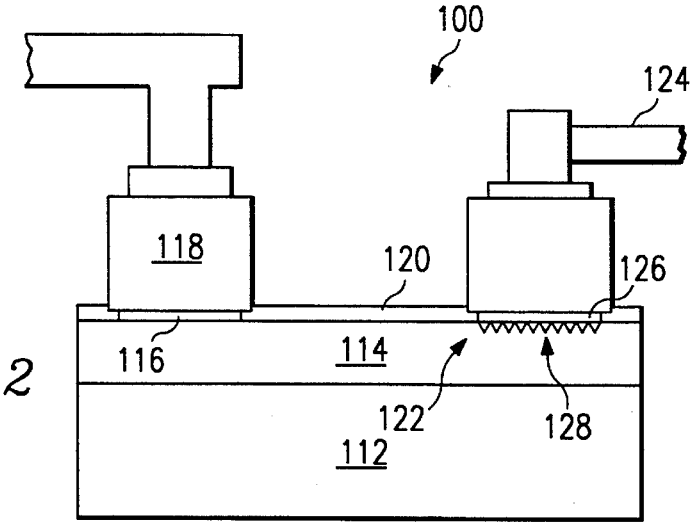
FIG. 2 is a cross-sectional view of a CMP machine according to the invention.

The preferred embodiment the invention is shown in FIG. 2. CMP machine 100 contains a polishing pad 114 secured to a platen 112. Polishing pad 114 typically comprises polyurethane. However, it will be apparent to those skilled in the art that other materials such as those used to make pads for glass polishing, may be used. In addition, the hardness of polishing pads 114 may vary depending on the application. Platen 112 is operable to rotate during polishing.

Rotating carrier 118 is operable to position wafer 116 on polishing pad 114 and apply force to press the wafer 116 against polishing pad 114. Rotating carrier 118 may position a single wafer 116 or several wafers or there may be more than one rotating carrier 118. Several methods of attaching a wafer to rotating carrier 118 are known in the art. For example, the wafer 116 may be bonded to the rotating carrier 118 by a thin layer of hot wax. Alternatively, a poromeric film may be placed on the bottom of the rotating carrier 118. The bottom of rotating carrier 118 would then have a recess (or recesses) for holding the wafer 116. When the poromeric film is wet, the wafer is kept in place by surface tension. Rotating carrier 118 is operable to rotate the wafer 116 against polishing pad 114.

A slurry 120 covers polishing pad 114. Slurry 120 is preferably introduced to the polishing pad 114 near the center of the pad. However, other positions for introducing the slurry are possible. A typical slurry for interlevel dielectric planarization comprises silicon dioxide in a basic solution such as KOH (potassium hydroxide) which is diluted with water. However, other slurry compositions will be apparent to those skilled in the art.

Conditioning head 122 is a semiconductor substrate 126 having a non-planar surface. For example, patterned geometries 128 may be formed in the surface of the substrate 126 by etching the surface of the substrate 126. Geometries 128 are topographical structures in the surface of substrate 126. Some preferable semiconductor substrate materials include amorphous, crystalline, or polycrystalline silicon and silicon carbide. However, it will be apparent to those skilled in the art that other materials may alternatively be used. Geometries 128 have a feature size on the order of the polishing pad cell size (i.e., 30 μm). Size refers to width and length of a structure. The size and shape of geometries 128 may vary. However, geometries 128 should not be much larger than the polishing pad cell size in order to minimize the physical damage to polishing pad 114 and the pattern of geometries should be relatively uniform so that even conditioning of the entire useable pad surface occurs. Several embodiments of conditioning head 122 will be described hereinbelow. Conditioning head 122 is held by movable arm 124. Movable arm 124 is operable to press conditioning head 122 onto the surface of polishing pad 114 while it moves conditioning head 122 over the surface of polishing pad 114.

In operation, both the wafer 116 and the polishing pad 114 are rotated at a constant angular velocity. Slurry 120 is continuously added to the surface of pad 114 causing used slurry to drain over the edges of the pad 114. Particles are removed from the wafer by the chemical abrasives in the slurry 120 and the mechanical abrasion of the polishing pad 114. As a result, planarization and/or selective removal of material is accomplished. Unfortunately, some particles removed from the wafer 116 as well as particles from the slurry 120 become embedded in the polishing pad 114. The remaining particles remain suspended in the slurry 120 and are washed over the edge of polishing pad 114 as new slurry is added. The pad 114 must be conditioned to avoid a condition known a glazing. Glazing occurs when so many particles build up on the polishing pad 114 that the wafer 116 begins to hydroplane over the surface of the polishing pad 114. Surface removal rates continue to drop as the glazing continues.

Conditioning of polishing pad 114 is accomplished by moving conditioning head 122 across the surface of polishing pad 114. Movable arm 124 presses the non-planar surface of conditioning head 122 against the surface of polishing pad 114 while it moves conditioning head 122 across the surface of polishing pad 114. During this process, geometries 128 extend into the surface of polishing pad 114. This mechanical abrasion of polishing pad 114 causes the particles embedded in polishing pad 114 to be removed from the pad 114 into the slurry 120. Then, as additional slurry 120 is added, the spent slurry 120 containing the removed particles is rinsed over the edges of polishing pad 114 into a drain (not shown). Removing the particles from the polishing pad 114 enables the depleted pad surface to be recharged with new slurry and greater pad surface area. Pad conditioning may occur during wafer 116 polishing or between wafer polishes. The conditioning head according to the invention will cause less physical damage to the pad than current conditioning techniques do, thus extending the life of the polishing pad.

Figure 3A:
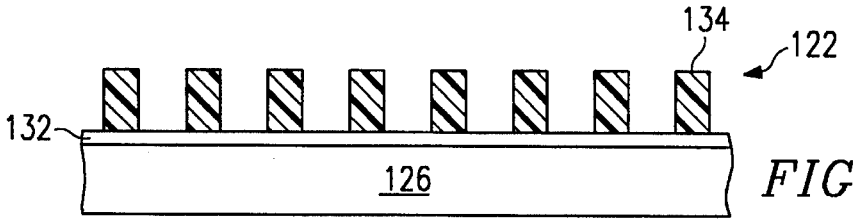
FIGS. 3*a–c* are cross-sectional views of a conditioning head according to a first embodiment of the invention at various stages of fabrication.

A first embodiment of conditioning head 122 will be described in conjunction with FIGS. 3*a–c*. Referring to FIG. 3*a*, substrate 126 is a semiconductor substrate and may comprise, for example, an amorphous, polycrystalline or crystalline substrate such as crystalline silicon. A masking layer 134 is formed on the surface of substrate 126 by, for example, depositing a layer of photoresist and exposing and developing the photoresist (using a projection printer for example) to create the desired pattern. If resist integrity is an issue, a hard mask 132 may be formed over the surface of substrate 126 prior to forming masking layer 134. Hard mask 132 may comprise a layer of oxide having a layer of nitride thereover.

Figure 3B:
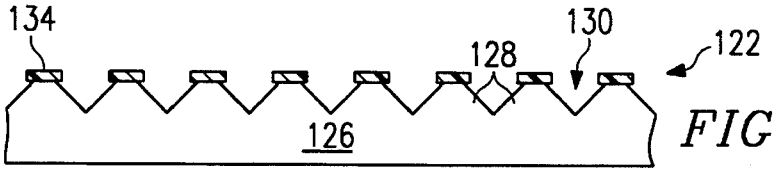

Referring to FIG. 3*b*, a wet etch solution with preferential etch rates along different crystallographic planes could be used to etch V-grooves 130 into the substrate 126 to create a non-planar surface. For example, a 19 weight percent potassium hydroxide in water at 80° C. could be used. Such an etch gives a 400:1 etch rate selectivity between (110) and (111) planes in silicon. This creates a plurality of geometries 128 having a size on the order of polishing pad 114 cell size (i.e., 30 μm). Having the size of geometries 128 on the order of pad cell size causes less physical damage to the polishing pad 114 than prior art methods. Geometries 128 are preferably evenly distributed over the surface of substrate 126 in order to accomplish uniform conditioning of polishing pad 114. After the wet etch, a cleanup may be performed according to well known techniques.

Figure 3C:
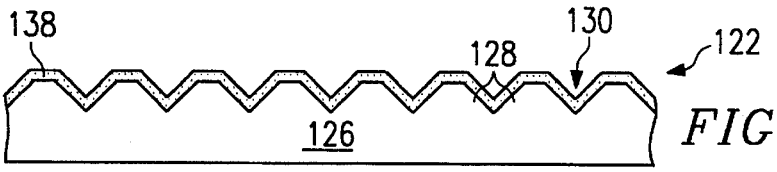

Referring to FIG. 3*c*, the non-planar surface of substrate 126 may optionally be vapor or sputter coated with a film for additional hardness. For example, a silicon carbide film or a diamond film 138 could be vapor deposited (e.g., by chemical-vapor deposition) on the surface of substrate 126.

Figure 4A:
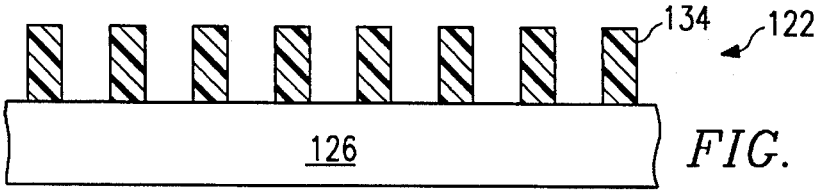
FIGS. 4*a–c* are cross-sectional views of a conditioning head according to a second embodiment of the invention at various stages of fabrication.

A second embodiment of conditioning head 122 will be described in conjunction with FIGS. 4*a–c*. Referring to FIG. 4*a*, substrate 126 is a semiconductor substrate and may comprise, for example, silicon carbide. A masking layer 134 is formed on the surface of substrate 126 as described above with respect to the first embodiment.

Figure 4B:
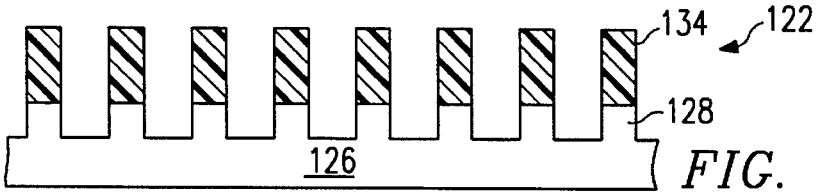
Figure 4C:
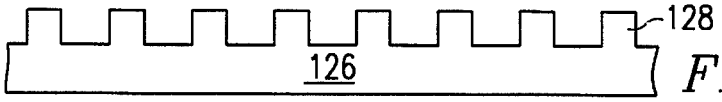

Referring to FIG. 4*b*, a plasma-mode or reactive-ion-mode reactor is used to anisotropically transfer the pattern to the substrate 126. This creates a non-planar surface having a plurality of arbitrarily shaped, straight-walled geometries 128 each having a size on the order of polishing pad 114 cell size (i.e., 30 μm). Again, geometries 128 are preferably evenly distributed over the surface of substrate 126 in order to accomplish uniform conditioning of polishing pad 114, as shown in FIG. 4*c*. After cleanup, substrate 126 may be chemically or physically vapor coated if desired for additional hardness. For example, a silicon carbide or diamond film may be vapor coated on the surface of substrate 126.

Figure 5A:
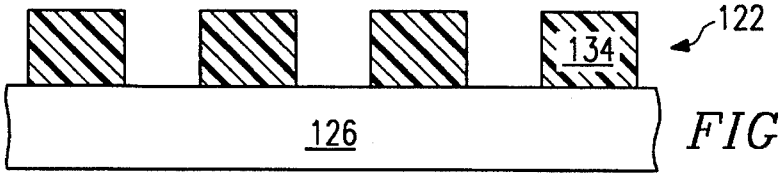
FIGS. 5*a–c* are cross-sectional views of a conditioning head according to a third embodiment of the invention at various stages of fabrication.
Figure 5B:
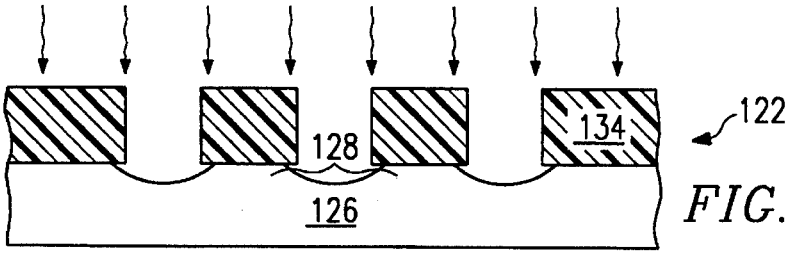
Figure 5C:
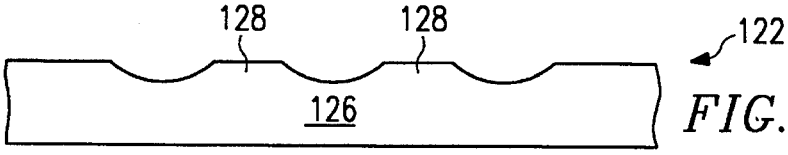

A third embodiment of conditioning head 122 will be described in conjunction with FIGS. 5*a–c*. Referring to FIG. 5*a*, substrate 126 is a semiconductor substrate and may comprise, for example, silicon carbide. A masking layer 134 is formed on the surface of substrate 126 as described above with respect to the first embodiment. Referring to FIG. 5*b*, a plasma-mode or reactive-ion-mode reactor is used to isotropically transfer the pattern to the substrate 126. This creates a non-planar surface having a plurality of geometries 128 of a size on the order of polishing pad 114 cell size (i.e., 30 μm). Geometries 128, in this embodiment, have a smoother conditioning profile (due to the isotropic etching) which potentially causes even less physical wear of polishing pad 114. Again, geometries 128 are preferably evenly distributed over the surface of substrate 126 in order to accomplish uniform conditioning of polishing pad 114, as shown in FIG. 5*c*. After cleanup, substrate 126 may be vapor or sputter coated if desired for additional hardness. For example, a silicon carbide or diamond film may be vapor coated on the surface of substrate 126.

Figure 6:
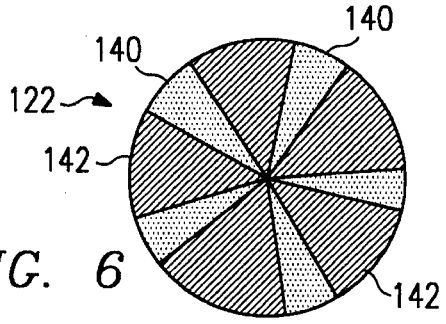
FIG. 6 is a plan view of a conditioning head according to the invention having slurry channels.

Those skilled in the art will understand that many tailored conditioning head patterns can easily be designed and then fabricated by processes similar to those described above. For example, slurry channels 140 can be formed in the surface 142 of conditioning pad 122 as shown in FIG. 6. Slurry channels 140 may be similar to slurry channels formed in prior art machined heads.

While this invention has been described with reference to illustrative embodiments, this description is not intended to be construed in a limiting sense. Various modifications and combinations of the illustrative embodiments, such as forming differently shaped or sized geometries, as well as other embodiments of the invention, will be apparent to persons skilled in the art upon reference to the description. It is therefore intended that the appended claims encompass any such modifications or embodiments.

What is claimed is:

1. A Chemical-Mechanical Polishing machine comprising:

a. a polishing pad;

b. a conditioning head comprising a semiconductor substrate having a non-planar semiconductor surface; and c. a conditioning head arm for positioning said conditioning head over a surface of said polishing pad.

2. The machine of claim 1, wherein said non-planar surface is shaped into a plurality of evenly distributed geometries.

3. The machine of claim 2, wherein said plurality of geometries each has a size on the order of a cell size of said polishing pad.

4. The machine of claim 2, wherein said plurality of geometries each has a size on the order of 30 μm.

5. The machine of claim 2, wherein each of said plurality of geometries comprises slanted sidewall edges such that the slanted sidewall edges of two adjacent geometries form a V-shaped groove.

6. The machine of claim 2, wherein said plurality of geometries are each straight-walled geometries.

7. The machine of claim 2, wherein each of said plurality of geometries comprises curved sidewall edges.

8. The machine of claim 1, wherein said semiconductor substrate comprises a material selected from the group consisting of amorphous, crystalline, or polycrystalline silicon.

9. The machine of claim 1, wherein said semiconductor substrate comprises silicon carbide.

10. The machine of claim 1, further comprising a hardening film located over said non-planar surface.

11. The machine of claim 10, wherein said hardening film comprises silicon carbide.

12. The machine of claim 10, wherein said hardening film comprises a diamond film.

13. A chemical-mechanical polishing (CMP) machine comprising:

a polishing pad comprising a plurality of cells; and a conditioning head comprising a semiconductor substrate having a non-planar semiconductor surface, wherein said non-planar semiconductor surface is shaped into a plurality of geometries, each of said plurality of geometries having a width on an order of magnitude of a width of one of said cells.

14. The CMP machine of claim 13, wherein said plurality of geometries are evenly distributed in said surface of said semiconductor substrate.

15. The CMP machine of claim 13, wherein each of said plurality of geometries comprises slanted sidewalls.

16. The CMP machine of claim 13, wherein each of said plurality of geometries comprises straight sidewalls.

17. The CMP machine of claim 13, wherein each of said plurality of geometries comprises curved sidewalls.

18. The CMP machine of claim 13, further comprising a hardening film located over said plurality of geometries.

19. The CMP machine of claim 18 wherein said hardening film comprises silicon carbide.

20. The CMP machine of claim 18 wherein said hardening film comprises a diamond film.

* * * * *